United States Patent [19]

Koiso

[11] Patent Number: 5,029,316

[45] Date of Patent: Jul. 2, 1991

[54] TONER SEAL METHOD AND APPARATUS IN ELECTROPHOTOGRAPHIC RECORDING APPARATUS

[75] Inventor: Jun-ichi Koiso, Tokyo, Japan

[73] Assignee: Konica Corporation, Tokyo, Japan

[21] Appl. No.: 545,839

[22] Filed: Jun. 29, 1990

[30] Foreign Application Priority Data

Jul. 12, 1989 [JP] Japan ..... 1-181308

[51] Int. Cl.[5] ..... G30G 21/00

[52] U.S. Cl. ..... 355/299; 15/256.51; 118/652; 355/296

[58] Field of Search ..... 355/215, 260, 298, 245, 355/251, 252, 253, 247, 296, 299; 277/53; 118/653, 654, 656, 657, 658, 652; 15/256.51

[56] References Cited

U.S. PATENT DOCUMENTS 4,417,807 11/1983 Yamazaki et al. ..... 15/256.51 X 4,681,426 7/1987 Bean et al. ..... 118/652 X

FOREIGN PATENT DOCUMENTS 1438704 11/1973 United Kingdom .

OTHER PUBLICATIONS

Lynch, Thomas J., Xerox Disclosure Journal, May/-Jun. 1983, vol. 8, No. 3, p. 259.

*Primary Examiner*—A. T. Grimley

*Assistant Examiner*—Patrick J. Stanzione

*Attorney, Agent, or Firm*—Finnegan, Henderson, Farabow, Garrett and Dunner

[57] ABSTRACT

A toner seal method and apparatus, wherein the leakage of a residual toner on a photosensitive member surface, which is removed by a blade of a photosensitive member cleaning device inside an electrophotographic recording apparatus and stored in a recovery casing is prevented by a toner seal member. The seal member is folded so as to come into contact with the photosensitive member surface, an end surface of the blade and an end surface of a toner guide plate for the casing and bonded to the casing near a photosensitive member.

8 Claims, 3 Drawing Sheets

TONER SEAL METHOD AND APPARATUS IN ELECTROPHOTOGRAPHIC RECORDING APPARATUS

BACKGROUND OF THE INVENTION:

1. (Field of the Invention)

This invention relates to a toner seal method and apparatus of a photosensitive member cleaning device disposed inside an electrophotographic recording apparatus.

2. (Description of the Prior Art)

The principal mechanism and the outline of the operation of an electrophotographic recording apparatus will be explained with reference to FIG. 6. As a general construction, a developing device 2 is disposed on the right of a photosensitive member 1 and a photosensitive member cleaning device 3 is disposed on the left. A transfer electrode 4 for a recording sheet of paper (hereinafter referred to as "paper") and a separating electrode 5 adjacent to the former are disposed below the photosensitive member 1, so that, paper 6 passes above the transfer electrode 4 and the separating electrode 5 while keeping contact tangentially with the photosensitive member 1.

The photosensitive member 1 is rotated continuously in a direction represented by arrow by a main motor, not shown in the drawing, and is provided with a predetermined potential by a charging electrode 1*a*. A latent image is first formed on the photosensitive member 1 by exposure 15 and when it reaches the position of the developing device 2, a toner 12 inside the developing device attaches to the portion of the 1*a* tent image due to the electrostatic action with the photosensitive member 1, forming thereby a toner image 16. On the other hand, paper 6 is transferred to the lower surface of the photosensitive member 1 by a pair of conveyor rollers 7*a* disposed on a front transfer table 7 and the toner image 16 is transferred to this paper 6 by the potential of the transfer electrode 4. After the potential applied at the time of transfer is removed by the separating electrode 5, paper 6 is subsequently transferred to a rear transfer table 7*b* and then to a fixing device 13, where fixing treatment is carried out. Thereafter, paper is discharged outside the electrophotographic recording apparatus and the image recording process is complete.

After the transfer to paper 6 is complete, the photosensitive member 1 is separated from paper 6 and reaches the cleaning device 3, where the residual toner 12*a* attaching to the surface and residual toner 12*a* attaching to the surface and other foreign matters such as paper dust are removed by a blade 3*a* fitted to the cleaning device 3. A recovery casing 9 of the cleaning device 3 is equipped with a toner guide plate 11 made of a PET material and is shaped in a sealed type. Particularly, its blade end portion surface and the portion of the photosensitive member surface of the photosensitive member 1 are provided with a toner seal member in order to prevent invasion and scatter of the residual toner 12*a* and the paper dust that have been removed, into the electrophotographic recording apparatus.

The inventions and devices related with the technique described above are well known in the art and are disclosed in the following references. As to the end portion seal of the photosensitive member blade, the following references are known:

Japanese Patent Laid-Open No. 155877/1984

Japanese Utility Model Laid-Open No. 122970/1985

As to the end portion seal of the blade, the following references are known:

Japanese Patent Laid-Open No. 72470/1984

Japanese Patent Laid-Open No. 15274/1984

Japanese Utility Model Laid-Open No. 30760/1982

Japanese Utility Model Laid-Open No. 115274/1985

As to the end portion seal of the toner guide plate, the following reference is known:

Japanese Patent Laid-Open No. 34580/1984

As to the end portion seal of the photosensitive member, the following references are known:

Japanese Utility Model Publication No. 12128/1985

Japanese Utility Model Laid-Open No. 16154/1985

Japanese Utility Model Laid-Open No. 159548/1983

As to the photosensitive member surface seal at the end portion of the photosensitive member, the following reference is known:

Japanese Utility Model Laid-Open No. 121474/1986

After cleaned in the manner described above, the photosensitive member 1 rotates again to the position of the exposure 15 with a predetermined potential and then the first step of image recording is started. In this way, the steps of exposure to the photosensitive member 1, development, transfer, separation, cleaning and fixing of the image to paper 6 are carried out repeatedly and continuously and image recording to paper 6 is effected.

The photosensitive member cleaning device 3 is one of the important functions of the electrophotographic recording apparatus with the developing device 2 and the fixing device 13. The residual toner 12*a* and the paper dust that attaches to the surface of the photosensitive member 1 are removed and cleaned by the cleaning device 3 after transfer and the exposure 15 is made to this cleaned photosensitive member surface. Accordingly, a clear toner image 16 can be always obtained. However, the residual toner 12*a* and the paper dust that have thus been removed enter and scatter from the side surface of the blade 3*a* and near the photosensitive member surface at the end portion of the photosensitive member 1 into the electrophotographic recording apparatus. They attach to the charging electrode 1*a*, the transfer electrode 4 and the separating electrode 5, contaminate the surfaces of a mirror and a lens, invite non-uniform transfer, the drop of density and non-uniform density that are detrimental to the recorded image and further cause troubles such as transfer jam of paper 6 due to incomplete separation. The frequency of the maintenance work must be increased in order to prevent these troubles and the economical loss is great.

Various inventions and devices have been developed conventionally as described already by disposing the toner seal member inside the cleaning device 3 in order to eliminate the problems described above. Though they provide a certain level of effects, none of them are entirely satisfactory. In other words, they divide, cut and patch up function-wise a flexible member such as a Moltopren, velvet or woolen cloth in such a manner as to come into contact with the photosensitive member surface, the blade end surface and the end surface of the toner guide plate, and the complicated and fine work relies exclusively on the skill of an assembling person. Accordingly, uniformity and reliability in mass-production are not yet complete.

SUMMARY OF THE INVENTION

In order to solve the problems described above, the present invention contemplates to provide a toner seal method and apparatus which can be adapted easily and reliably even to a narrow and complicated surface.

The object described above can be accomplished by either of the following method and apparatus.

In a photosensitive member cleaning device disposed inside an electrophotographic recording apparatus, a toner seal method which is characterized in that a toner seal member for preventing leakage of a residual toner on a photosensitive member surface, which is removed by a blade and stored in a recovery casing, is folded in such a manner as to come into contact with the photosensitive member surface, an end surface of the blade and an end surface of a toner guide plate for the casing which is in parallel with the end surface of the blade, and is bonded to the casing near a photosensitive member, said folding being made in a direction crossing the weaving direction of loops of a velvet woven fabric constituting the seal member.

In a photosensitive member cleaning device disposed inside an electrophotographic recording apparatus, a toner seal apparatus which is characterized in that a toner seal member for preventing leakage of a residual toner on a photosensitive member surface which is removed by a blade and stored in a recovery casing is bonded to the casing at its portion near a photosensitive member and an end portion of the blade, said seal member being bonded through a rigid member having a shape that models the casing to be bonded.

The above and other objects and novel features of the present invention will become more apparent from the following description when taken in conjunction with the accompanying drawings.

BRIEF DESCRIPTION OF THE DRAWINGS:

FIG. 2(*b*) is a sectional view of the velvet woven fabric folded in a direction crossing the weaving direction of loops, particularly at right angles;

Figure 3:
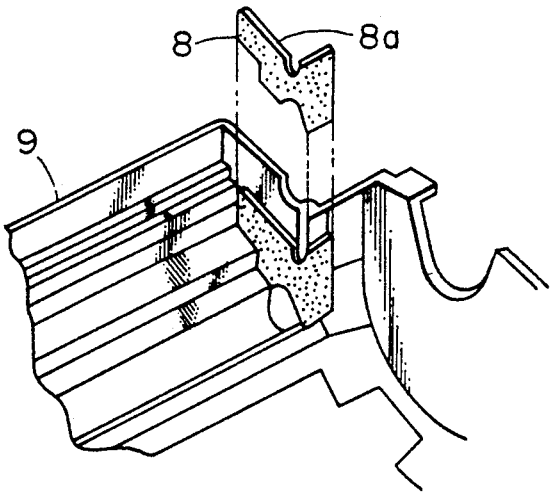
FIG. 3 is a perspective view showing the bond position of the toner seal member to a recovery casing.
Figure 4A:
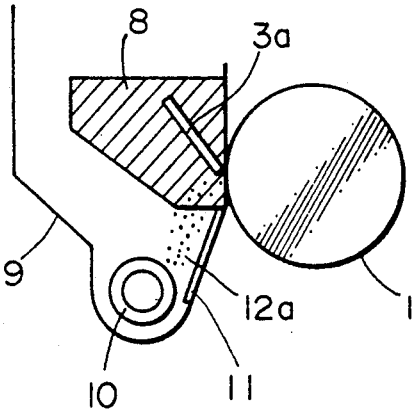
FIGS. 4(*a*) and 4(*b*) are front view and plan view showing the position relationship between the photosensitive member, the blade and the toner guide plate with respect to the toner seal member bonded to the casing.
Figure 4B:
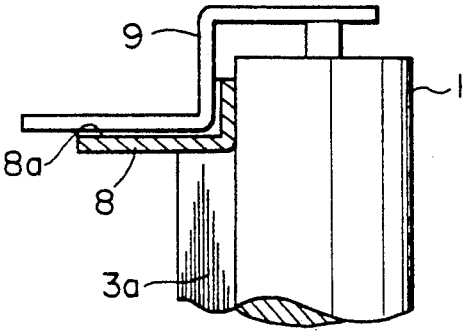
Figure 5A:
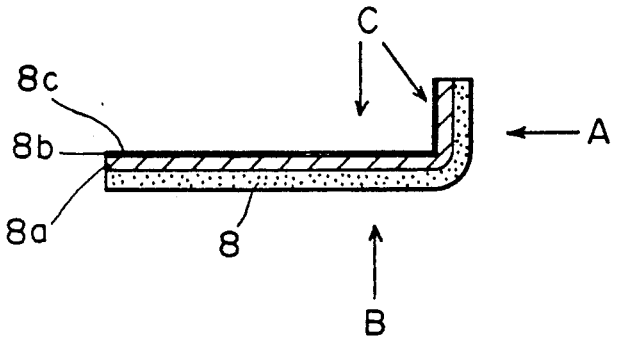
FIGS. 5(*a*) and 5(*b*) are top sectional view and front view of the toner seal in accordance with the present invention.
Figure 5B:
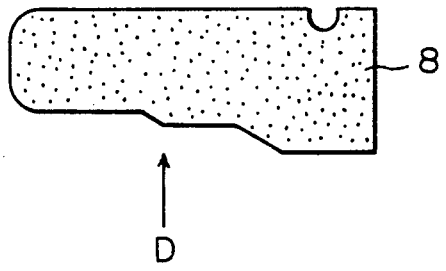
Figure 6:
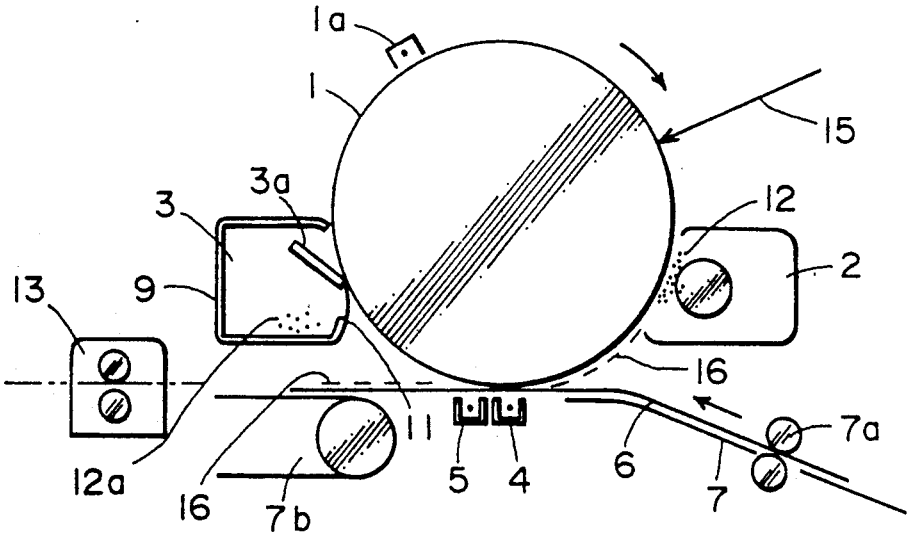
FIG. 6 PRIOR ART
FIG. 6 is a side view of a conventional electrophotographic recording apparatus.

DESCRIPTION OF THE PREFERRED EMBODIMENTS:

As shown in FIGS. 3, 4(*a*) and 4(*b*), the casing 9 described above has a frame for supporting rotatably the photosensitive member 1 and for holding members such as a blade 3*a*, a toner transfer screw 10 and a toner guide plate 11, besides its function of storing the residual toner. Therefore, it has a complicated shape having an upper side surface portion, a bottom surface portion, a ridge line and a step portion and its space is extremely limited. Unlike the toner seal member of the prior art apparatuses, a toner seal member 8 in accordance with the present invention is made of a flexible fluff-like member such as a felt, a velvet or a woolen cloth and fixed to a rigid support member 8*a* such as a single metallic plate as shown in FIGS. 5 (*a*) and 5(*b*). This support member 8*a* is provided with a bent portion A in match with the shape of the casing 9 and a step portion D of a lower surface and is designed so that a surface C and the step portion D serve as bonding reference surfaces. A double-face adhesive tape 8*b* is bonded with an upper sheet 8*c* to the C surface side of the support member 8*a*. To fit the support member 8*a* to the casing 9, it can be bonded along the shape of the casing after peeling the upper sheet 8*c* as shown in FIG. 3. A surface portion B of the toner seal member 8 bonded in this manner covers an end surface of the photosensitive member 1 and the bent portion A simultaneously covers end surface portion of the blade 3*a* and toner guide plate 11 under the state where it comes into light pressure contact with them. Accordingly, it is sealed without applying any trouble to the operation of each of these members. Therefore, the residual toner 12*a* and paper dust recovered do not leak and scatter outside the casing 9 but are sequentially transferred to a predetermined position by the toner screw 10 through the toner guide plate 11 and are then recovered.

According to the structure described above, the fitting reference of the toner seal member 8 is clear and definite. Since it is equipped with the support member made of the stiff material, the toner seal member 8 can be fitted easily and reliably, its fitting does not require any specific skill and fitting variance during mass-production can be eliminated completely.

Since the present invention is constituted as described above, fitting of the toner seal member 8 is simple and reliable, the work done factor can be improved remarkably and leakage and scatter of the residual toner 12*a* and the paper dust into the electrophotogaphic recording apparatus do not occur. In consequence, contamination of important functional portions does not occur and a quality recorded image can be obtained for an extended period of time. Since the frequency of the cleaning maintenance work due to contamination inside the apparatus can be reduced remarkably, the economical effect is extremely great, too.

According to the embodiment described above, leakage of the toner from the toner storage portion of the casing 9 would not occur but the toner sometimes falls off from the folds of the woven fabric described already. Therefore, another embodiment of the present invention makes it possible to prevent the fall of the toner easily and reliably.

Figure 1C:
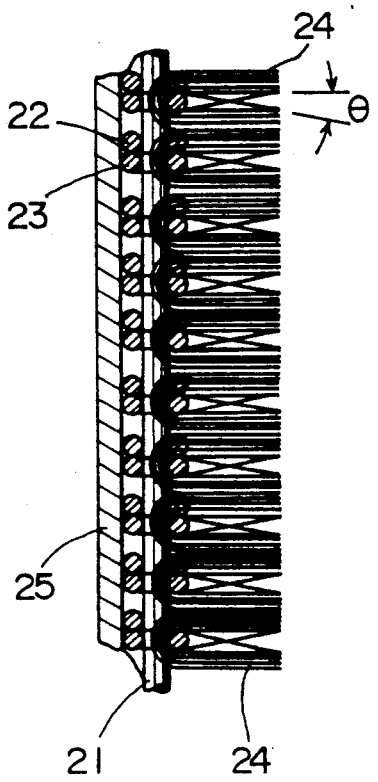
FIGS. 1*(a)*, 1*(b)* and 1*(c)* are top view, front sectional view and side sectional view of a velvet woven fabric used for a toner seal member in one embodiment of the present invention.
Figure 1A:
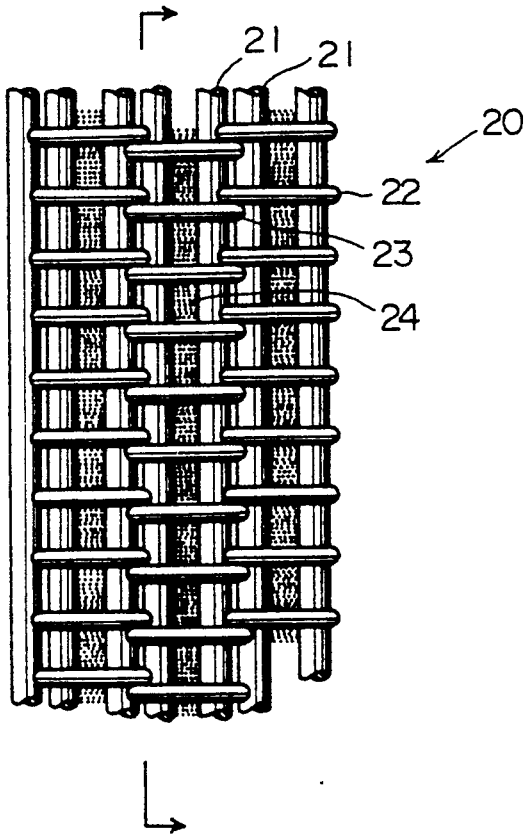
Figure 1B:
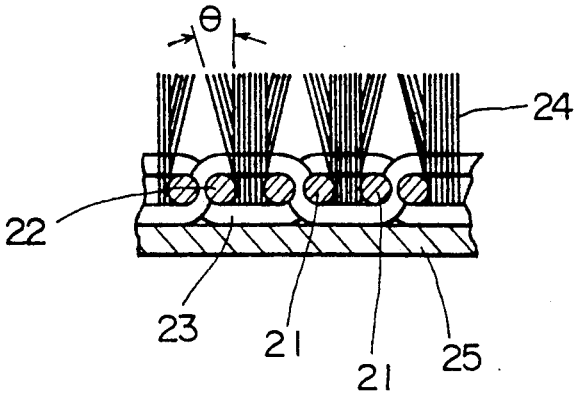

First of all, an example of fluffed woven fabrics 20 such as the velvet, the woolen cloth, etc (which will be sometimes referred to as the "velvet fabric") will be explained with reference to FIGS. 1(*a*), 1(*b*) and 1(*c*). Piles 24 of bundles of a large number of thin yarns are inserted and woven into wefts 22 or 23 in the same direction as warps 21 with a pitch of a predetermined number of warps 21 in the fabric woven by the warps 21 and the wefts 22, 23, and the loop-like piles between the adjacent wefts are finally cut at the intermediate portion. In this manner the fluffed woven fabric such as the velvet or the woolen cloth, to which the piles 24 are aligned in the same height and implanted, can be obtained as shown in the front sectional view of FIG. 1(*b*) or in the side sectional view of FIG. 1(*c*). The piles of this woven fabric are tightly bound by the warps 21 and the wefts 22 or 23 of the woven fabric and do not fall off, but a stitch fixing agent 25 is applied to the bottom portion of the fabric in order to prevent further strongly fall-off.

Incidentally, the structure of the warps and the wefts is not particularly limited to that of the embodiment described above. As the fluffed woven fabric, it is possible to use a moquette material consisting 100% of acrylic fibers and having the pile fluff length of 3 to 4 mm.

Figure 2A:
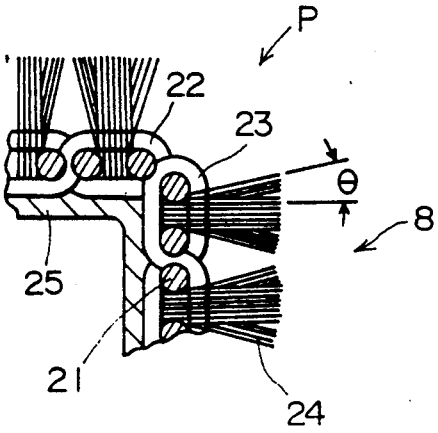
FIG. 2(*a*) is a sectional view of the velvet woven fabric folded in a direction parallel to a weaving direction of loops.
Figure 2B:
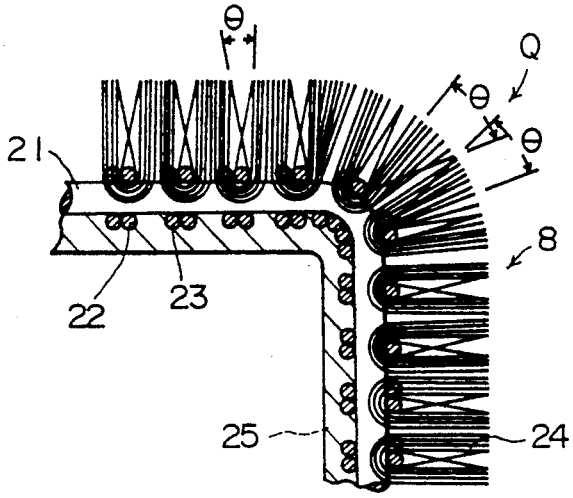

When such a woven fabric is used as the toner seal member by folding it, there are two folding methods, that is, the folding method which provides the folds in the direction in parallel with the warps 21 as shown in FIG. 2(*a*) and the folding method which provides the folds in the direction at right angles, or a certain angle, to the warps 21 as shown in FIG. 2(*b*). According to the former method, the pile density of the fold portions P is close to zero due to the properties of the woven fabric even when the expansion angle $\theta$ due to the turn-down of the pile yarns is taken into consideration, and the fold portion cannot at all play the role of the seal. Therefore, part of the residual toner 12*a* which has been scraped off falls down through this fold portion and contaminates the interior of the recording apparatus.

In contrast, in accordance with the latter, the pile yarn density of the folded portion Q does not much drop due to the expansion of the angle $\theta$ in the turn-down direction of the dense pile yarns, and the fall-off of the residual toner 12*a* does not occur. Though the intended object can be accomplished sufficiently even when this folding angle is not 90°, it is more preferably at right angles.

The bonding work of the toner seal member 8 to the limited position of the inner surface of the casing 9 having the complicated shape can be made easily and reliably without any specific skill by merely folding and bonding a single sheet of woven fabric in a predetermined direction but not cutting the woven fabric constituting the seal member into a plurality of pieces and bonding them. Moreover, the trouble of fall of the residual toner 12*a* into the recording apparatus can be eliminated completely.

Incidentally, bonding of the seal member 8 to the casing 9 is made by use of an adhesive. It can be made by coating the adhesive to the surface of the stitch fixing agent 25 or by bonding a double-face adhesive tape. Since the toner seal member 8 covers the photosensitive surface portion at the end of the photosensitive member 1 and the end surface portions of the blade 3*a* and the toner guide plate 11 under the lightly pressure-contact state, these members can be sealed without any trouble in their operations. Accordingly, the residual toner 12*a* and the paper dust recovered do not leak and scatter outside the casing but are transferred sequentially to the predetermined position by the toner screw 10 through the toner guide plate and recovered there.

Since this embodiment has the structure described above, fitting of the toner seal member can be made easily and reliably and the work done factor can be improved remarkably. Since leakage and scatter of the residual toner 12*a* and the paper dust into the electrophotographic recording apparatus do not occur, contamination of the important functional portions does not occur, either, a quality recorded image can be obtained for a long period and the economical effect is extremely great because the frequency of the cleaning maintenance work can be reduced remarkably.

What is claimed is:

1. A method for inhibiting the leakage of toner in an electrophotographic recording device while the toner is being removed from a surface of a photosensitive member by a blade and stored in a recovery casing, comprising the steps of:

providing a toner seal member including a woven fabric having a body and pile yarns extending from the body, the pile yarns having a predominant direction in the body of the woven fabric;

forming a fold in the woven fabric extending in a direction substantially perpendicular to the predominant direction; and attaching the toner seal member to the recovery casing such that the toner seal member contacts the surface of the photosensitive member on a first side of the fold and an end surface of the blade on a second side of the fold.

2. An apparatus for use in an electrophotographic recording device to inhibit leakage of toner which is removable from a surface of a photosensitive member by a blade to be stored in a recovery casing, the apparatus comprising:

a toner seal member attached to the recovery casing and engaging the photosensitive member and a portion of the blade, the toner seal member including a woven fabric having a body and pile yarns extending from the body, the pile yarns having a predominant direction in the body of the woven fabric, said woven fabric having a fold formed therein, said fold extending in a direction substantially perpendicular to the predominant direction.

3. The apparatus of claim 2 wherein the toner seal member is attached to a rigid member having a shape corresponding to the shape of a portion of the recovery casing and the rigid member is attached to the portion of the recovery casing.

4. The apparatus of claim 2 wherein the body of the woven fabric includes warps extending substantially parallel to the predominant direction and wefts passing about the warps and extending substantially perpendicular to the predominant direction, the warps and wefts attaching the pile yarns to the body of the woven fabric.

5. An apparatus for use in an electrophotographic recording device to inhibit leakage of toner, the recording device including a photosensitive member, a blade for the removal of toner from a surface of the photosensitive member, a toner guide plate which is substantially parallel to the surface of the photosensitive member, and a recovery casing for storing the removed toner, the apparatus comprising:

a toner seal member attached to the recovery casing, the toner seal member including a folded portion, a first portion disposed on a first side of the folded portion and extending substantially parallel to the surface of the photosensitive member and engaging the photosensitive member, and a second portion disposed on a second side of said folded portion and extending substantially parallel to a side wall of the recovery casing and engaging an end portion of the blade, the toner seal member engaging a portion of the toner guide plate.

6. The apparatus of claim 5 further comprising a rigid member having a shape corresponding to the shape of a portion of the recovery casing, the toner seal member being attached to the rigid member and the rigid member being attached to the portion of the recovery casing.

7. The apparatus of claim 5 wherein the toner seal member includes a woven fabric having a body and pile yarns extending from the body, the pile yarns having a predominant direction in the body of the woven fabric, said woven fabric having a fold formed therein, said fold extending in a direction substantially perpendicular to the predominant direction.

8. The apparatus of claim 7 wherein the body of the woven fabric includes warps extending substantially parallel to the predominant direction and wefts passing about the warps and extending substantially perpendicular to the predominant direction, the warps and wefts attaching the pile yarns to the body of the woven fabric.

* * * * *